United States Patent [19]

Lindner et al.

[11] Patent Number: 5,074,450

[45] Date of Patent: Dec. 24, 1991

[54] TRANSPORTED WEB ALIGNMENT APPARATUS

[75] Inventors: Georg J. Lindner, Veitshöchheim; Wolfgang L. Scheller, Oberpleichfeld, both of Fed. Rep. of Germany

[73] Assignee: Koenig & Bauer Aktiengesellschaft, Wurzburg, Fed. Rep. of Germany

[21] Appl. No.: 517,342

[22] Filed: May 1, 1990

[30] Foreign Application Priority Data

May 9, 1989 [DE] Fed. Rep. of Germany ..... 3915056

[51] Int. Cl.[5] ..... B65H 23/032

[52] U.S. Cl. ..... 226/21; 226/14; 226/189

[58] Field of Search ..... 226/3, 10, 14, 15, 18, 226/19, 21, 104, 105, 189

[56] References Cited

U.S. PATENT DOCUMENTS

| | | | |
|---|---|---|---|
| 2,989,265 | 6/1961 | Selsted | 226/21 X |
| 3,207,018 | 9/1965 | Rauenbuehler et al. | 226/25 X |
| 3,664,561 | 5/1972 | Feiertag | 226/21 |
| 3,693,855 | 9/1972 | Bonner | 226/21 X |
| 4,453,659 | 6/1984 | Torpey | 226/21 X |
| 4,901,903 | 2/1990 | Blanding | 226/21 X |
| 4,998,117 | 3/1991 | Shibuya et al. | 226/21 X |

FOREIGN PATENT DOCUMENTS 2365668 4/1976 Fed. Rep. of Germany .

*Primary Examiner*—Daniel P. Stodola
*Assistant Examiner*—P. Bowen
*Attorney, Agent, or Firm*—Jones, Tullar & Cooper

[57] ABSTRACT

An intermittent web transport apparatus in a printing machine guides the web between two processing positions and through an intermediate festoon. Web alignment deviations from a nominal value are corrected by rotation of a pivotable frame that is positioned downstream of the festoon. A correction roller before the festoon effects a shifting of the web prior to its entry into the festoon.

7 Claims, 3 Drawing Sheets

TRANSPORTED WEB ALIGNMENT APPARATUS

FIELD OF THE INVENTION

The present invention is directed generally to a transported web alignment apparatus. More particularly, the present invention is directed to an alignment apparatus for an intermittently transported web. Most specifically, the present invention is directed to an apparatus on a web-fed printing machine for the alignment for an intermittently transported web. The web is transported between spaced processing points and utilizes a festooner or a similar storage assembly to temporarily accumulate and hold the web between the two processing stations. Thus the web is transported intermittently between these stations. Thetransported web alignment apparatus compensates for web mis-alignment and pre-corrects the web going into the festooner in anticipation of possible web mis-alignment.

DESCRIPTION OF PRIOR ART

Intermittent web drive assemblies that are useable with web-fed printing machines are generally known in the art. These assemblies are typically situated between two processing stations which perform operations on the web either at differing speeds or in differing time sequences. Thus there is a need to temporarily store and hold a quantity of the web between the two processing stations. A festooner or a similar storage device often provides for the accumulation and holding of the web which may be fed into, and withdrawn from the festooner at differing rates of speed.

In German published unexamined patent application No. 2,365,668 there is shown an apparatus for the transport and temporary storage of a web which includes a low tension festoon assembly, an intermittent tape drive and a continuous tape drive. In this prior art device there is not provided a means for aligning the paper web in a lateral direction. However, a lateral aligning capability is quite necessary in a low tension festooner. Since the web is under only low tension forces, the friction forces which are needed to guide the web in a straight direction are missing. This means that the web is apt to move laterally out of its center path of transport as it is being moved forwardly. Factors such as uneven elongation of the paper web edges caused by different thicknesses in the paper web, ink or dampening fluid influences, or gumming or sticking of the paper web are apt to cause the web to drift or move either to the right or to the left in a low tension festoon assembly.

It will be readily apparent that such lateral shifting or mis-alignment of the paper web is detrimental to smooth and efficient operation. When the festoon assembly is situated between two processing points a mis-alignment of the web between the stations will clearly cause errors and poor quality results at the second processing point. Thus while the prior art has provided low pressure or low tension web intermittent transport and storage facilities, it has not provided a suitable web alignment assembly for these devices. The transported web alignment device of the present invention provides such an alignment capability and is a significant advance over the prior art.

SUMMARY OF THE INVENTION

It is an object of the present invention to provide a transported web alignment apparatus.

Another object of the present invention is to provide an alignment apparatus for an intermittently transported web.

A further object of the present invention is to provide an apparatus in a web-fed rotary printing machine for the alignment of an intermittently transported web.

Yet another object of the present invention is to provide an alignment apparatus for an intermittently transported web which is fed through a low tension festooner.

Still a further object of the present invention is to provide an alignment apparatus for an intermittently transported web which includes a pre-correction roller.

Even yet another object of the present invention is to provide a transported web alignment device including web edge sensing means.

As will be discussed in detail in the description of the preferred embodiment which is set forth subsequently, the transported web alignment apparatus of the present invention is positioned between first and second web processing stations. A paper web drive apparatus, which is capable of intermittent operation, is positioned between the two processing stations. This paper web drive apparatus includes a paper web drive or drag roller and a cooperating pressure roller which can be brought into engagement with or moved out of contact with the drag roller. Both the drag roller and the cooperating pressure roller are rotatably supported on a frame. This frame is horizontally pivotable to skew the rollers axes with respect to the direction of web transport. A pre-correction roller, which engages the web prior to its entry into the festooner, is pivotably connected to the frame for the paper web drive apparatus. This pre-correction roller also pivots generally horizontally to skew its axis. However the pivot direction of the pre-correction roller is opposite to the pivot direction of the web drive apparatus. This corrects the lateral offset of the web entering the festoon.

The ability of the transported web alignment apparatus to pre-correct the lateral offset of the web as it enters the festooner is one of the significant advantages of the present invention. This pre-correction counteracts the deflections created by the festoon and thus allows the transported web alignment device of the present invention to have a very quick reaction time.

The transported web alignment apparatus of the present invention utilizes a support frame for the paper web drive apparatus that is supported for horizontal pivoting motion by a plurality of low friction ball elements. The paper web passes around the drive roller and pressure roller at a high wrap angle. This allows the web to quickly and rapidly accelerate without slippage.

A further advantage of the transported web alignment apparatus is the connection of the drive roller frame with the pre-correction roller. This direct connection of the two reduces the need for additional drive devices. It allows the pre-correction roller to operate in direct response to the movement of the web drive apparatus frame.

BRIEF DESCRIPTION OF THE DRAWINGS

While the novel feature of the transported web alignment apparatus in accordance with the present invention are set forth with particularity in the appended claims, a full and complete understanding of the invention may be had by referring to the detailed description of the preferred embodiment, as presented subsequently, and as illustrated in the accompanying drawings, in which:

DESCRIPTION OF THE PREFERRED EMBODIMENT

Figure 2:
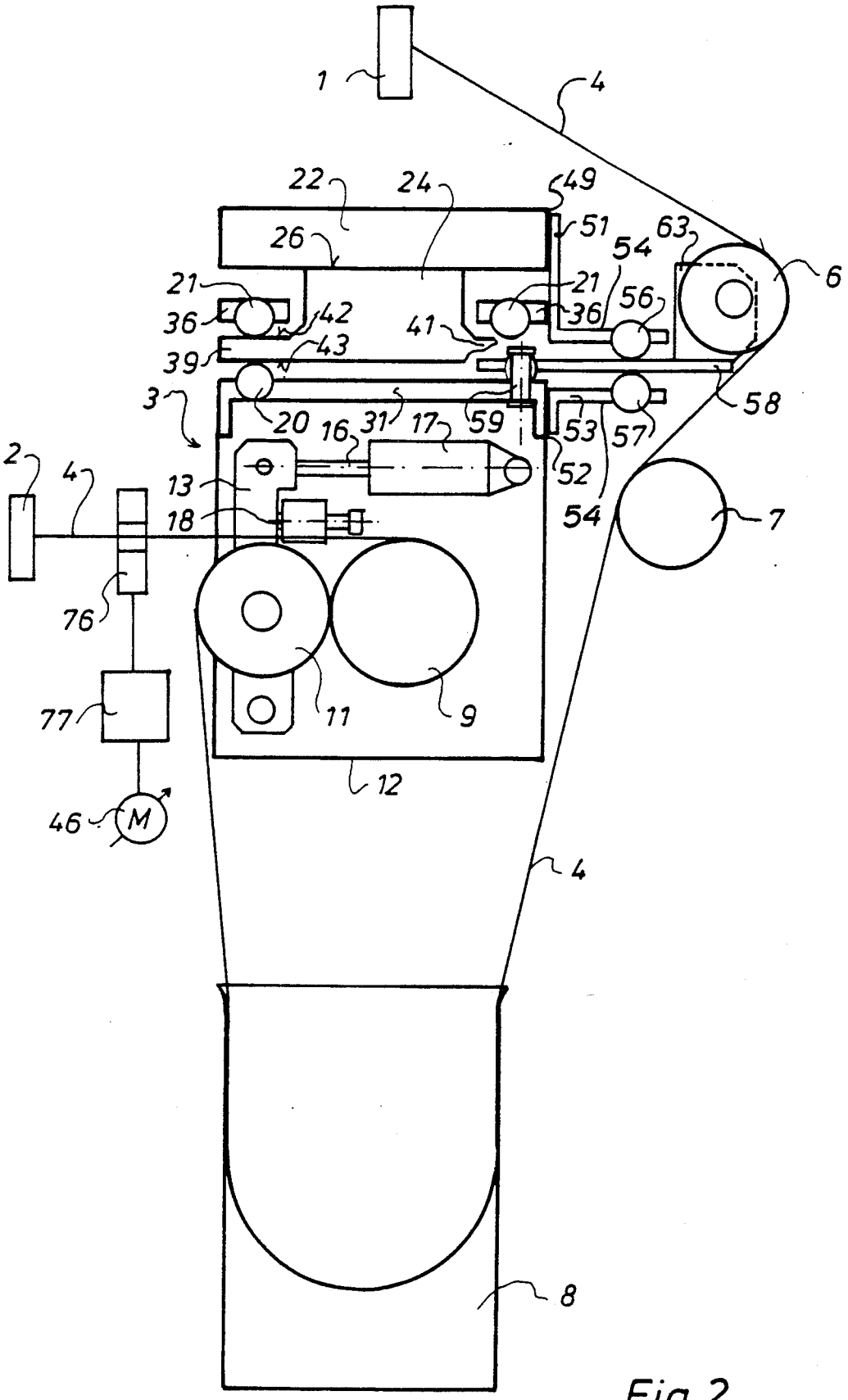
FIG. 2 is a schematic side elevation view of the overall transported web alignment apparatus of the present invention.

Referring initially to FIG. 2, there may be seen a preferred embodiment of a transported web alignment apparatus, generally at 3, in accordance with the present invention. This transported web alignment apparatus 3 is utilized in a web-fed printing machine in which a web of paper 4 is transported between a first processing station 1 and a second processing station 2 by way of a suitable web accumulating and deploying device such as a festooner, which is indicated generally at 8. The two processing stations 1 and 2 may be any typical devices such as, for example, a printing unit and a perforator.

As may be seen in FIG. 2, the paper web 4 leaves the first processing station 1 and is guided by a pivotably supported correction or pre-correction roller 6, as will be discussed in more detail subsequently. A rotatably supported roller 7 guides the web 4 from the pre-correction roller 6 to the festoon 8. This festoon 8 is a low pressure device and thus the angle of paper web infeed into it is controlled by the adjustably supported roller 7. As the paper web 4 leaves the festoon 8 it is first guided to the intermittent paper web drive apparatus 3 and then to the second processing station 2.

The intermittent paper web drive apparatus, generally at 3 has a driven drag roller 9 and a cooperating pressure roller 11 which can be moved into and out of contact with the drag roller 9. This drag roller 9 is rotatably supported in a frame 12 which may be seen in FIGS. 1 and 2. Frame 12 is generally in the shape of an open rectangle and includes an upper frame plate 31.

The cooperating pressure roller is rotatably supported adjacent the driven drag roller 9 by spaced levers 13, as may be seen in FIG. 2. Each of these levers 13 is pivotably connected at a lower, first end to side plates of frame 12. At their upper ends, the levers 13 are pivotably connected to piston rods 16 which extend from hydraulically or pneumatically actuated operating cylinders 17. These cylinders 17 are secured to the side plates of the frame 12. An adjustable stop 18 limits the travel of the pressure roller into engagement which the driven drag roller 9. Movement of pressure roller 11 toward or away from drag roller 9 is effected by control of pressure operating cylinder 17 in a generally conventional manner.

Frame assembly 12, which supports the drag roller 9, its cooperating pressure roller 11, and somewhat indirectly the pre-correction roller 6, is mounted for horizontal pivoting about a generally vertical pivot axis. As may be see in FIGS. 1 and 2, the frame 12 is pivotably supported by a plurality of spaced ball or roller elements 20 and 21 that engage spaced T-beams 24 which are supported from a cross bar 22. As may be seen most clearly in FIG. 1, cross bar 22 extends between side frames 19 and 25 of the press assembly. This cross bar 22 is generally transverse to the direction of the paper web travel, as shown in FIG. 2. Each of the T-beams 24 is secured to cross bar 22 is a generally inverted orientation with the foot of each of the T-beams 24 being securely affixed to cross bar 22. Each T-beam 24 has first and second arms 39 and 41 that have upper and lower faces 42 and 43 which are in contact with the support balls or rollers 21 and 20, respectively, as may be seen in FIGS. 1 and 2.

Figure 1:
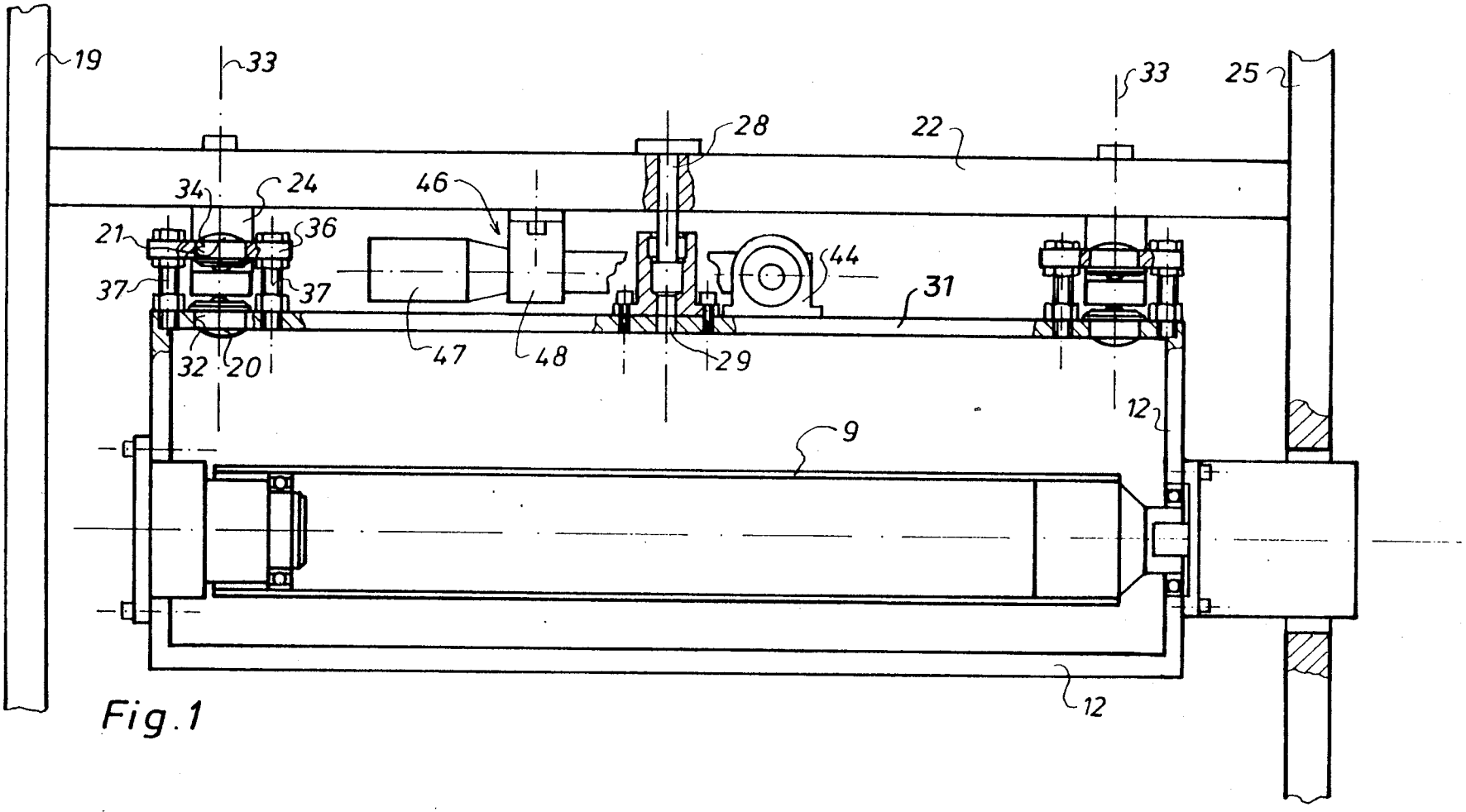
FIG. 1 is a front elevation view of the transported web alignment apparatus showing the paper web drive apparatus and pivotable frame.

Referring more primarily to FIG. 1, a bolt 28 is supported in cross bar 22 generally at the midpoint of bar 22. This bolt 28 extends downwardly and is secured in a cooperating socket or bracket 29 which is secured to the upper frame plate 31 of the frame 12. This bolt 28 defines the generally vertical pivot axis about which frame 12 pivots in a generally horizontal plane. Suitable sliding means surround bolt 28 in socket 29 to insure a low frictional pivoting action between bolt 28 and frame 12.

Upper frame plate 31 is provided which a plurality of spaced bores 32 in which the lower ball elements 20 are carried. In the preferred embodiment, there are provided four such bores 32. The upper ball elements 21 are arranged opposite to the lower balls 20 along common vertical axes 33. Each upper ball 21 is supported in a bore 34 formed in an upper supported plate 36. These upper support plates 36 are joined to the upper frame plate 31 of the pivotable frame 12 by sets of adjustable set screws 37. These set screws are used to keep the balls 20 and 21 at a desired spacing "a". This spacing "a" is approximately the thickness of the arms 39 and 41 of the T-beam 24 since, as may be seen in FIGS. 1 and 2, these arms are inserted between the upper and lower ball elements 21 and 20. In the preferred embodiment, spacing "a" is generally about 10 mm. Thus the upper balls 20 roll on the upper faces 42 of the T-beam arms 39 and 41 while the lower balls 21 roll on the lower faces 43 of these arms.

Turning again to FIG. 1, a second bracket or support 44 is secured to the upper surface of the upper frame 31. This second bracket 44 connects the pivotable frame 12 to the fixed cross bar 22 by means of an adjusting drive assembly 46. This adjusting drive 47 assembly 46 is comprised of a ballscrew drive and a direct current gear motor 48. The motor itself is secured to the cross bar 22 by any suitable securement means, such as clamps, flanges, angle irons or the like. Thus actuation of the gear motor 48 will cause the ballscrew drive 47 to rotate so as to pivot frame 12 about bolt 28. This pivoting movement is made easy by rolling cooperation between upper and lower balls 21 and 20 on arms 39 and 41 of the spaced T-beams 24.

Figure 3:
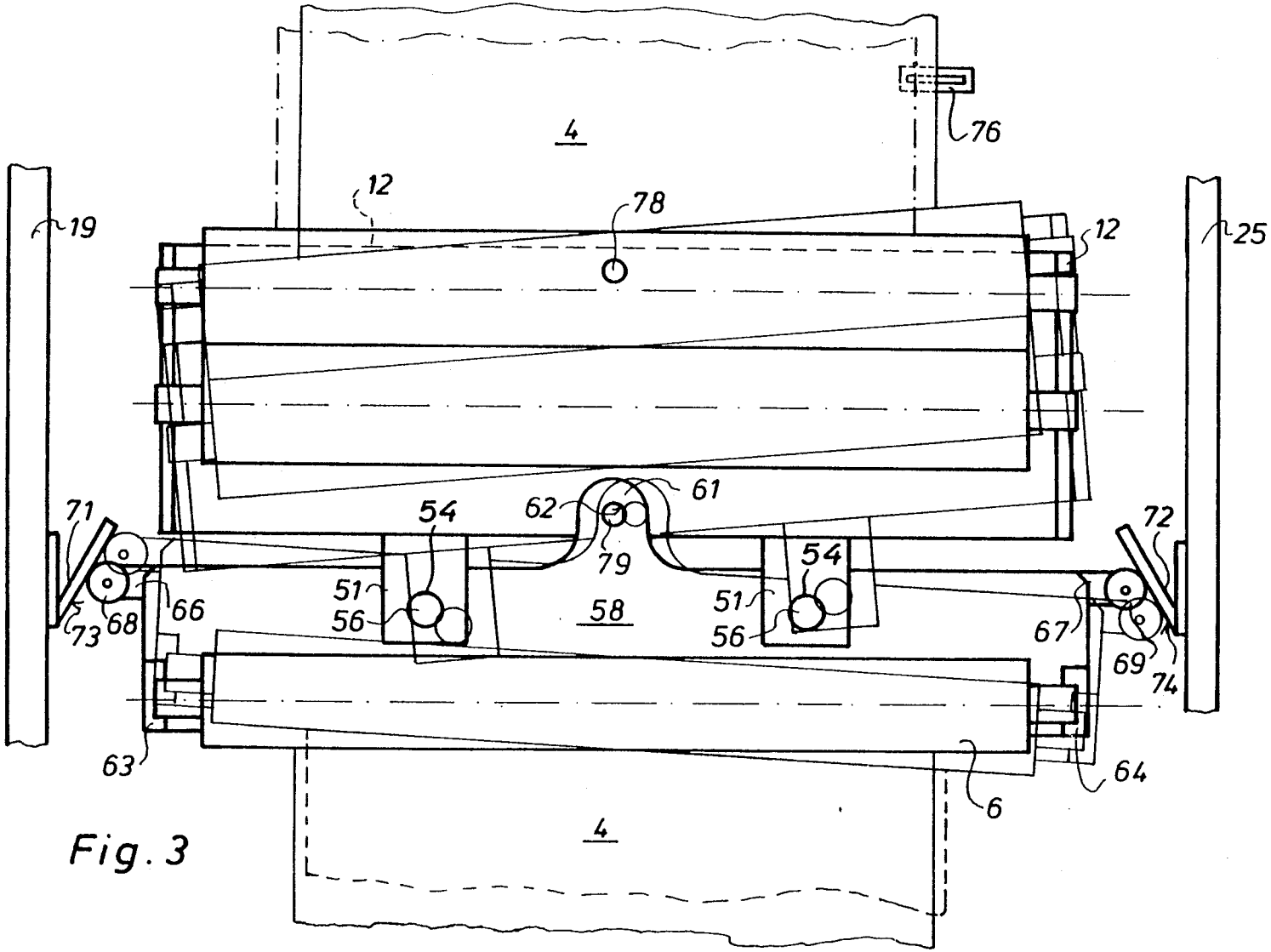
FIG. 3 is a top plan view of the pre-correction roller and paper web drive apparatus and their associated pivotable frames.

A pair of spaced upper support angles 51 are secured to a rear portion 49 of the cross bar 22, as seen in FIGS. 2 and 3. Two generally similar spaced lower support angles 53 are affixed to a rear portion 52 of the upper frame portion 31. Each of these support angles 51 and 53 have generally rearwardly extending horizontal arms and each of these arms has at least one bore 54. These bores 54 support upper ball elements 56 and lower ball elements 57 in the upper and lower support angles 51 and 53, respectively. These ball elements 56 and 57 carry and support a bearing plate 58 between them, as seen most clearly in FIG. 2. This bearing plate 58 is pivotably supported for movement in a generally horizontal plane about a vertical pivot axis or point 79 by a bolt 59. This bolt 59 is secured to upper frame plate 3, generally adjacent its rear portion 52 and generally equidistant the two side plates of the pivotable frame 12. Bolt 59 extends generally vertically upwardly.

Bearing plate 58, as may be seen most clearly in FIG. 3, has a central tongue 61 which is provided with a borehole 62. This borehole 62 is placed about the bolt 59. A pair of generally vertically upwardly directed bearing brackets 63 and 64 are affixed to bearing plate 58. These bearing brackets 63 and 64 form the support for the pre-correction roller 6.

As is shown primarily in FIG. 3, the bearing plate 58 carries opposed, outwardly extending arms 66 and 67. These arms, which are directed toward the inner surfaces of the spaced side frames 19 and 25, carry rollers 68 and 69 on their outer, free ends. The rollers 68 and 69 are provided to contact inclined surface planes 73 and 74 of inclined angle brackets 71 and 72. These brackets 71 and 72 are attached to the inner surfaces of the side frames 19 and 25 and are angled inwardly in a direction so that the inclined surface planes 73 and 74 converge in the direction of web travel toward the second processing station.

Again referring to FIG. 3, several positions of a paper web 4 traveling through the transported web alignment apparatus in accordance with the present invention may be seen. The continuous line denotes the nominal position of the web 4. The dot and dash line shows the actual position of the web; while the position of the web 4 as corrected by the pre-correction roller 6 is shown in a broken line.

In operation, a paper web 4, which is being directed toward the pre-correction roller 6 from the first processing station has a nominal or desired position, as shown in the continuous line. The paper web passes over the pre-correction roller 6 and the support roller 7 and enters into the festoon 8. It is then fed out of the festoon 8 and into the intermittent paper web drive apparatus 3 where it exits the drag roller 9 with an actual position, as depicted by the dot and dash lines, which is shifted to the left, in the direction of web transport as viewed from above in FIG. 3, from the desired nominal position shown in continuous lines. The deviation of this actual position from the desired nominal position is sensed by a generally conventional web edge scanning means or a line scanning means, as depicted at 76 in FIGS. 2 and 3. The output from this scanning device 76 is provided to a suitable, generally conventional electrical evaluation circuit means which is depicted at 77 in FIG. 2. This electrical evaluation circuit means 77 carries out an actual value-nominal value comparison and then transmits a suitable adjustment signal to the gear or servomotor 48. Depending on the actual position of the paper web 4, the servomotor 48 will rotate the ballscrew to shift the pivotable frame 12 either clockwise or counterclockwise about the bolt 28 and the pivot point or rotational axis 78 defined thereby. The shifting of the pivotable frame 12 will effect a skewing of the paper web drive apparatus 3 which is carried by frame 12.

In the example as depicted in FIG. 3, when the paper web 4 has a actual position which is shifted to the left from a nominal position, as sensed by the sensing means 76, the frame 12 is pivoted in a counterclockwise direction, as viewed from above in FIG. 3. This shifting about the rotation point 78, will have the effect of displacing the web to the right so that its actual position will be shifted toward the desired nominal position.

The paper web drive apparatus has now been skewed to its left in comparison to its nominal position. It is necessary to return the drag roller 9 and the pressure roller 11 back to their nominal positions or else the web 4 will continue to be shifted to the right. This is accomplished by the pre-correction roller 6. As may be seen in FIG. 3, the pre-correction roller is used to shift the paper web 4, before it enters the festoon 8, to the right into a pre-corrected position. The pre-correction roller 6 is supported by bearing plate 58 and is pivoted about its pivot point 79 in a direction opposed to the pivoting direction of the pivotable frame 12. Thus as the frame 12 is rotated counterclockwise, the bearing plate 58 moves in a clockwise direction. This skews the pre-correction roller 6 in a direction opposite to the skew direction of the drag roller 9 and the pressure roller 11. The opposing motions of these rollers work together to keep the paper web 4 in its nominal position and hence to restore the drag roller 9, the pressure roller 11 and the correction roller 6 to these nominal positions.

In the preferred embodiment, the pivoting movement of the frame 12 taken place about the bolt 28. It would also be possible to pivot this frame about other centers of revolution. Suitable means, such as pivotably connected levers which might be used to join the pivotable frame 12 to the cross bar 22 could be used. In a situation such as that, the center of revolution of the pivoting action could be outside of the frame 12. In this case, the center of revolution would be determined by the point of intersection of elongations of these levers. Furthermore, the pivoting movement of the pivotable frame 12 could be effected by suitable control cams or guide rods.

While a preferred embodiment of a transported web alignment apparatus in accordance with the present invention has been set forth fully and completely hereinabove, it will be apparent to one of skill in the art that a number of changes in, for example the drive means of the drag roller, the sizes of the rollers, the specific types of processing stations and the like can be made without departing from the true spirit and scope of the invention. Accordingly, the subject invention is to be limited only by the following claims.

What is claimed is:

1. A transport alignment apparatus for the alignment of an intermittently transported web, said transport alignment apparatus comprising:

an intermittent web drive means which is positioned after, in the direction of web travel, and which receives the web from a festoon, said intermittent web drive means being supported in a pivotable frame;

a pivotable correction roller which is positioned before, in the direction of web travel, and which directs the web to the festoon, said pivotably correction roller effecting a pre-correction of the web before the web is received by the festoon;

a pivotable bearing plate supporting said pivotable correction roller;

means connecting said pivotable bearing plate to said pivotable frame; and means causing said pivotable bearing plate to pivot in opposition to said pivotable frame whereby pivotal movement of said pivotable frame which supports said intermittent web drive means in a first direction causes pivotal movement of said pivotable bearing plate which supports said pivotable correction roller in a second, opposing direction.

2. The transported web alignment apparatus of claim 1 wherein said intermittent web drive means includes a driven roller and a cooperating pressure roller which may be brought into and out of contact with said driven roller.

3. The transported web alignment apparatus of claim 1 wherein a plurality of ball elements are provided for the pivotable support of said pivotable frame.

4. The transported web alignment apparatus of claim 1 wherein a plurality of ball elements are provided for the pivotable support of said pivotable correction roller.

5. The transported web alignment apparatus of claim 1 including guiding means for controlling pivoting motion of said pivotable correction roller.

6. The transported web alignment apparatus of claim 1 wherein said pivotable frame is pivotably supported by a bolt secured to said pivotable frame.

7. The transported web alignment apparatus of claim 1 further including a web edge scanning means which provides web edge position information to an evaluation means which effects operation of a drive measure for movement of said pivotable frame.

* * * * *